US007120375B2

(12) United States Patent
Ransom et al.

(10) Patent No.: US 7,120,375 B2
(45) Date of Patent: Oct. 10, 2006

(54) COVER PROP MECHANISM

(75) Inventors: Patrick Lawrence Ransom, Lexington, KY (US); Brandon Sung-Hawn Song, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 177 days.

(21) Appl. No.: 10/767,685

(22) Filed: Jan. 29, 2004

(65) Prior Publication Data

US 2005/0169662 A1 Aug. 4, 2005

(51) Int. Cl.
*G03G 399/11* (2006.01)
*E05D 15/58* (2006.01)

(52) U.S. Cl. ..... 399/114; 49/260; 399/110

(58) Field of Classification Search ..... 399/107, 399/110, 114, 367, 380; 347/138, 152; 16/289, 16/290; 49/260; 312/327
See application file for complete search history.

(56) References Cited

U.S. PATENT DOCUMENTS

| | | | | |
|---|---|---|---|---|
| 938,427 | A * | 10/1909 | Malocsay | 49/260 |
| 4,223,483 | A | 9/1980 | Stafford | |
| 4,742,598 | A * | 5/1988 | Bruneau | 16/286 |
| 5,086,316 | A | 2/1992 | Aoki | |
| 5,365,315 | A | 11/1994 | Baker et al. | |
| 5,526,097 | A | 6/1996 | Ream | |
| 5,595,317 | A | 1/1997 | Hodge | |
| 5,752,135 | A | 5/1998 | Coffey et al. | |
| 5,787,323 | A | 7/1998 | Nomura et al. | |
| 5,802,432 | A | 9/1998 | Coffey et al. | |
| 5,937,242 | A | 8/1999 | Yokoyama et al. | |
| 6,276,562 | B1 | 8/2001 | Hodge et al. | |
| 6,446,307 | B1 | 9/2002 | Wilkins | |
| 6,494,631 | B1 | 12/2002 | Mastinick | |
| 6,560,931 | B1 | 5/2003 | Cermola | |
| 2001/0044986 | A1 | 11/2001 | Wilkins | |
| 2002/0041782 | A1 | 4/2002 | Mastinick et al. | |
| 2002/0048479 | A1 | 4/2002 | Bryant et al. | |

FOREIGN PATENT DOCUMENTS

| | | | |
|---|---|---|---|
| JP | 06247214 | A | 6/1994 |
| JP | 09146534 | A | 6/1997 |

* cited by examiner

*Primary Examiner*—Arthur T. Grimley
*Assistant Examiner*—Ryan Gleitz
(74) *Attorney, Agent, or Firm*—Steven J. Elleman

(57) ABSTRACT

A housing assembly includes a housing having an access opening and a cover movable between a closed position wherein the cover generally covers the access opening and an open position wherein the cover generally does not cover the access opening. The assembly further includes a protrusion located on one of the housing or the cover, and a track located on the other one of the housing or the cover. The protrusion is slidably received in the track, and the track forms a generally closed loop shape such that the protrusion slides in the track when the cover is moved between the open and the closed positions. Additionally ramps may be provided on portions of the track to provide user feed back and to inhibit reverse motion of the protrusion.

26 Claims, 6 Drawing Sheets

COVER PROP MECHANISM

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention is directed to a cover prop mechanism, and more particularly, to a cover prop mechanism which can retain the cover in its open position.

2. Description of the Related Art

Business machines, such as printers, copiers, facsimile machines, scanners, multifunction machines such as printer/copier/scanner, and the like typically include a body or housing that provides structural integrity to the device. In order to provide access to the internal components of the device, the body typically includes an access opening that is protected by a movable cover. The cover is movable between an open position and a closed position such that the internal components of the device can be accessed through the access opening. The cover itself may contain components. For example in a multifunction machine, the cover may contain a scanner that is lifted in order to access other internal components.

Various mechanisms may be utilized to prop the cover in its open position. However, existing prop mechanisms may be difficult to access and operate, and may require two-hand operation. Accordingly, there is a need for a cover prop mechanism which is easy to access and operate and which may be operated using a single hand.

SUMMARY

In one embodiment, the present invention is a cover prop mechanism which is easy to access and operate and which can be operated using a single hand. In particular, one embodiment of the invention is a housing assembly including a housing having an access opening and a cover movable between a closed position wherein the cover generally covers the access opening and an open position wherein the cover generally does not cover the access opening. The assembly further includes a protrusion located on one of the housing or the cover, and a track located on the other one of the housing or the cover. The protrusion is slidably received in the track, and the track forms a generally closed loop shape such that the protrusion slides in the track when the cover is moved between the open and the closed positions.

Other objects and advantages of the present invention will be apparent from the following description and the accompanying drawings.

DETAILED DESCRIPTION

Figure 1:
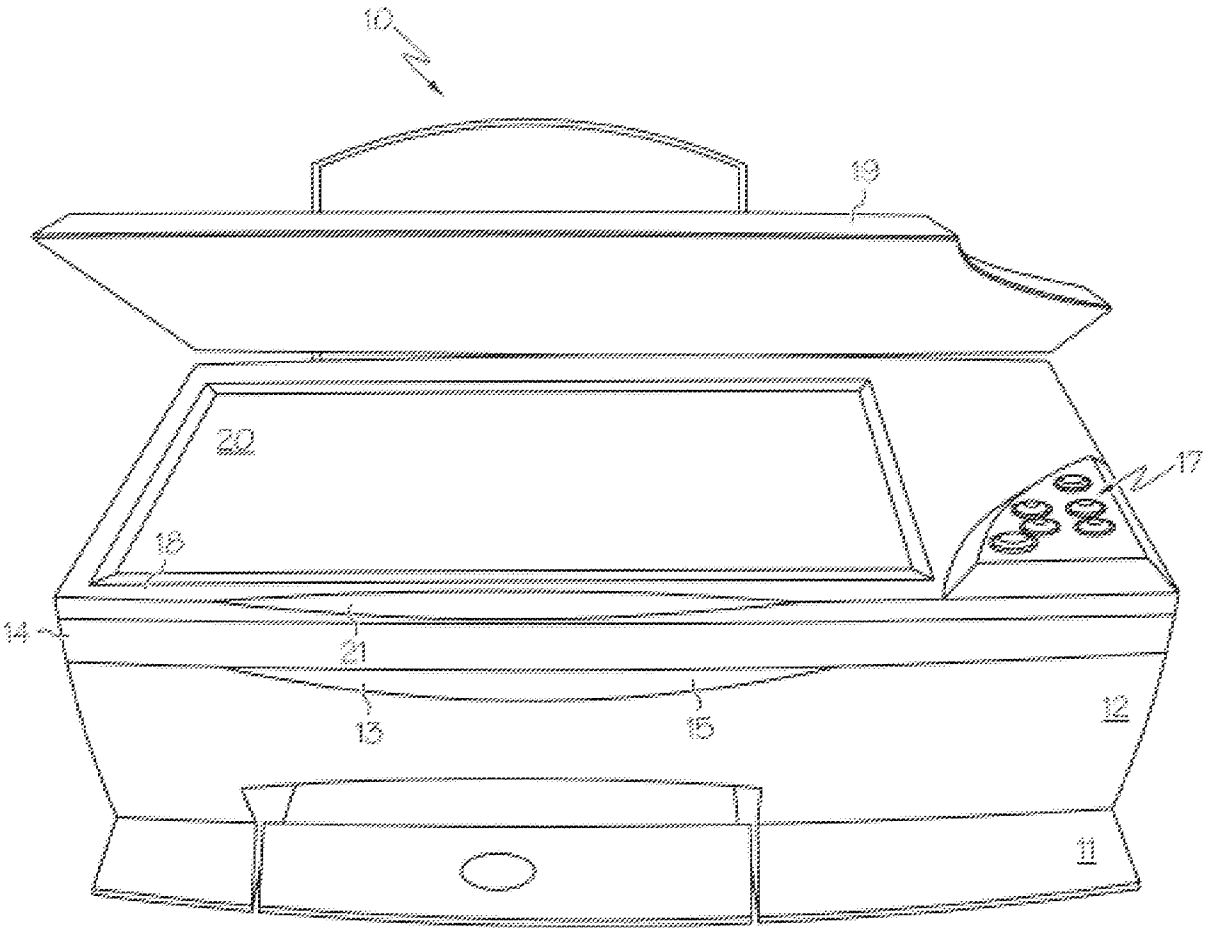
FIG. 1 is a front perspective view of a multifunction machine which includes the cover prop mechanism of the present invention.
Figure 2:
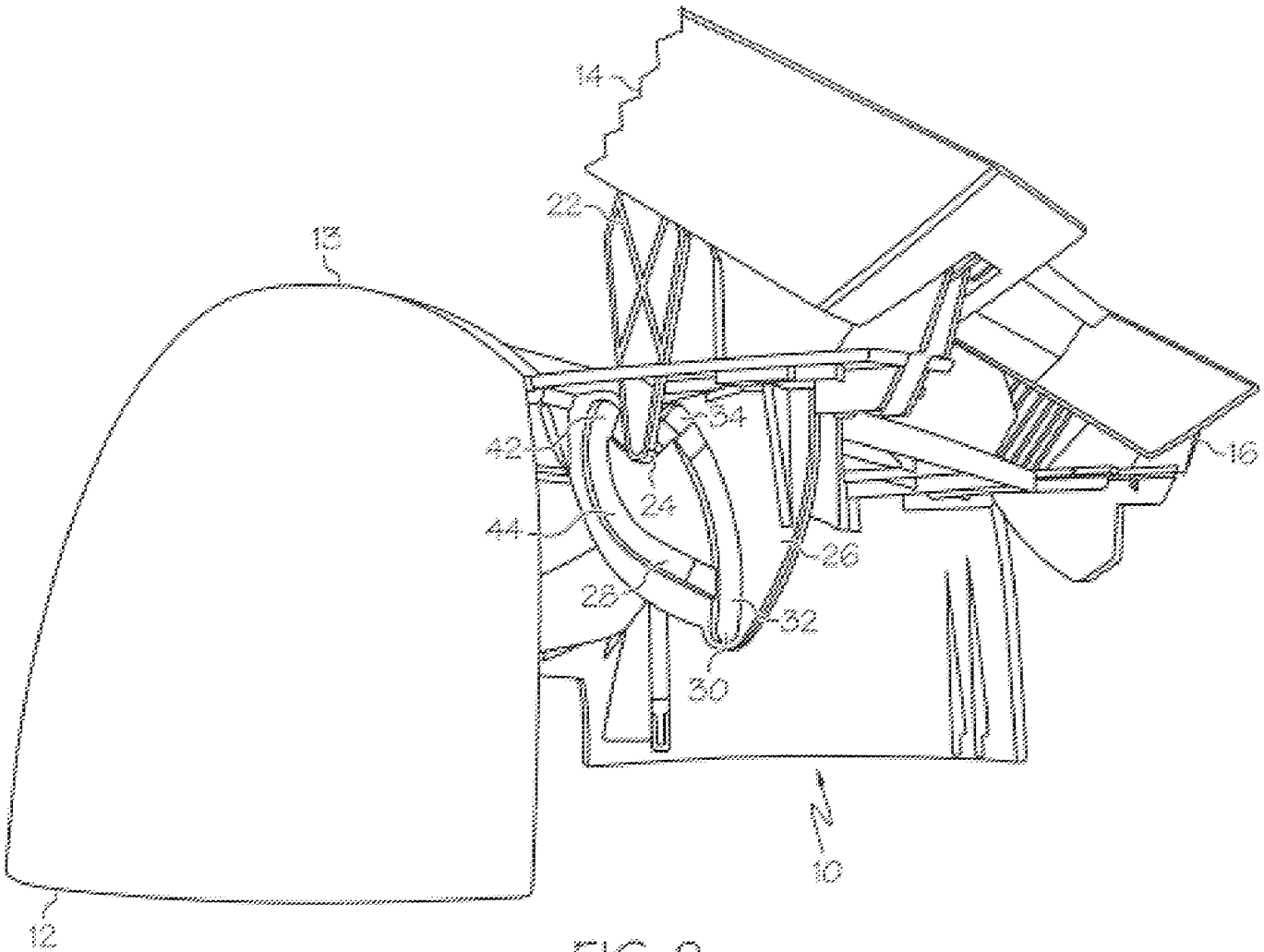
FIG. 2 is a rear perspective view of the multifunction machine of FIG. 1, with the cover in section shown in its open position.
Figure 3:
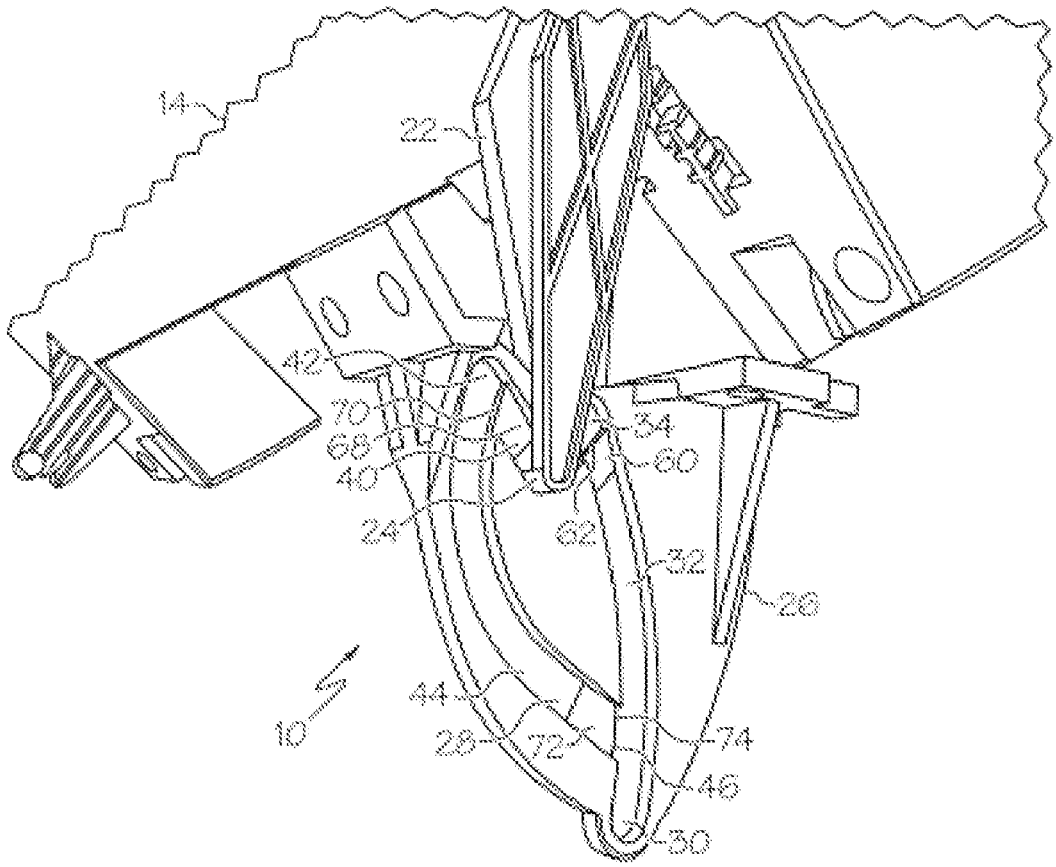
FIG. 3 is a front perspective sectional detail view of the track and arm of the multifunction machine of FIG. 2.
Figure 4:
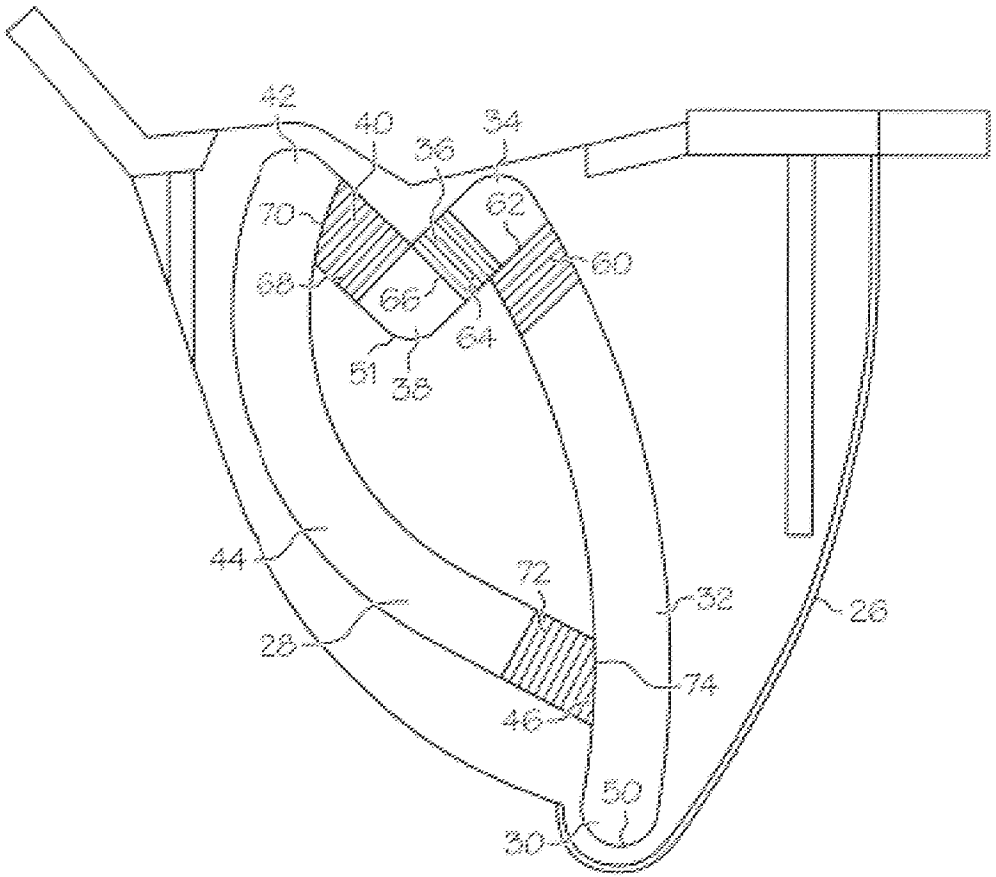
FIG. 4 is a front view of the track body of the multifunction machine of FIG. 3.
Figure 5:
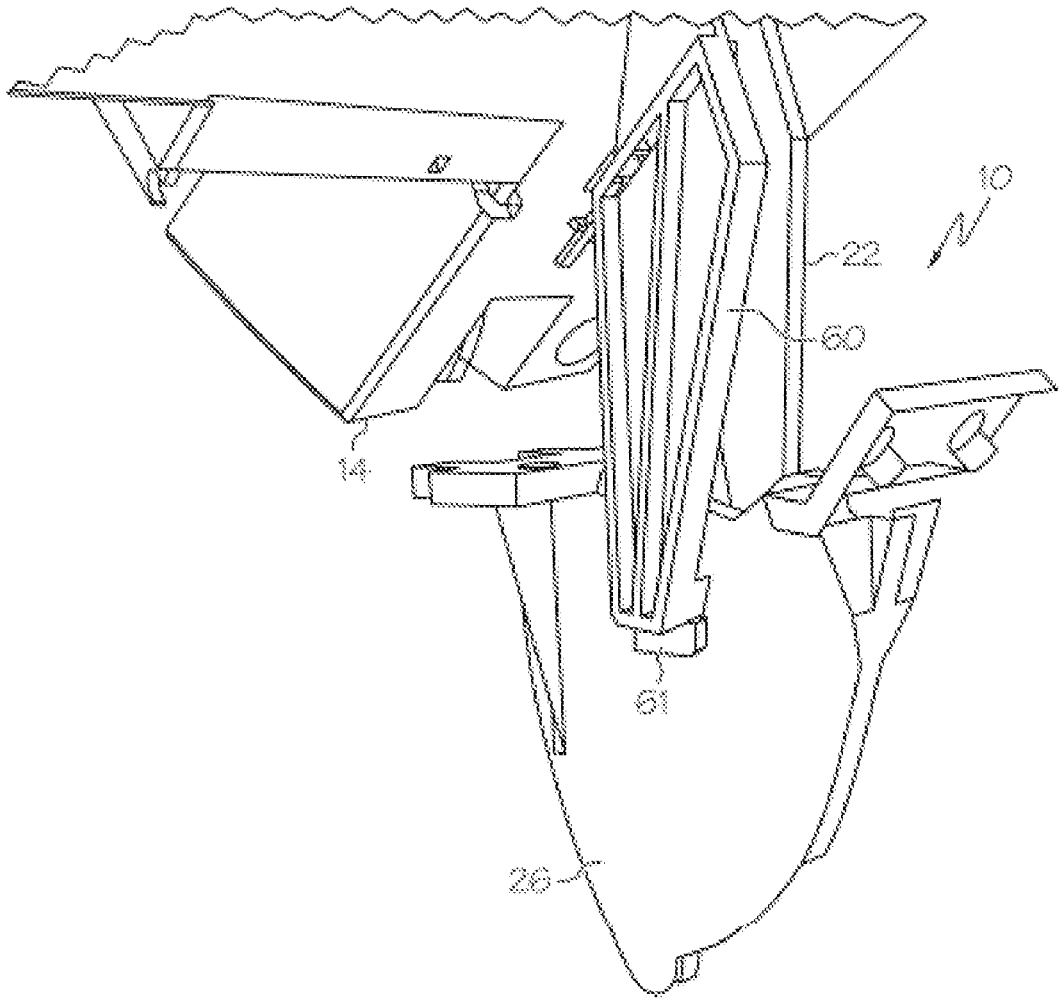
FIG. 5 is a rear sectional perspective view of the arm and support tab of the multifunction machine of FIG. 1.

As shown in FIGS. 1–6, the prop mechanism or housing assembly of the present invention, generally designated 10, may include, be used in or incorporated into a business machine 11, such as a printer, copier, facsimile machine, scanner, a multifunction machine such as a printer/copier/scanner or a printer/copier/scanner/facsimile and the like having a housing 12. The housing 12 includes an access opening 13 that is selectively covered by a cover 14. A slight cutaway 15 or indentation is provided in housing 12 adjacent an edge of the cover 14 to allow a user a convenient finger hold to grasp the cover 14 when opening or closing. A finger hold may also be provided on the cover 14 or on both the cover 14 and housing 12. The cover 14 is pivotally coupled to the housing 12 by a hinge mechanism 16. In this manner, the cover 14 is movable between a closed position wherein the cover 14 generally covers the access opening 13 (FIG. 1) and an open position wherein the cover 14 generally does not cover the access opening 13 (FIGS. 2 and 5). The access opening 13 may be used to reach consumable components, such as ink cartridges, that are internally located. In this exemplary embodiment, the cover 14 also includes a control panel 17 and a scanner 18 having a lid 19 used to cover the platen aperture 20 of scanner 18. A second cutaway 21 is provided on the cover 14 to allow a user a finger hold for lifting the lid 19.

As best shown in FIGS. 2–3, the housing assembly 10 may include an arm 22 that is pivotally coupled to the cover 14. The arm 22 extends generally vertically downwardly, and includes a protrusion 24 at its lower distal end. As best shown in FIG. 3, the protrusion 24 may be an extruded shape which is generally circular in cross section. The arm 22 and/or housing assembly 10 may have a spring (not shown) such that the arm 22 is spring biased toward the front of the business machine (i.e., in the illustrated embodiment the distal end of the arm 22 may be biased in the clockwise direction about its pivot point or to the left in its position shown in FIGS. 2 and 3). However, the arm 22 need not necessarily be spring biased, and could instead simply be freely pivotable.

The housing assembly 10 may include a track body 26 which includes a track 28 formed therein. In an illustrated embodiment, the track 28 is a recessed portion or cutout formed in the track body 26. However, any of a wide variety of shapes or structures which can act as a guide or track 28 may be used. As best shown in FIG. 4, the track 28 may include a first rest location 30, which is the lowest location of the track 28. The first rest location 30 is a relatively low location so that any immediately adjacent portions of the track 28 extend generally upwardly away from the first rest location 30.

The track 28 includes a first portion 32 which extends generally upwardly from the first rest location 30 to a first intermediate location 34. The track 28 includes a second portion 36 which extends from the first intermediate location 34 to a second rest location 38. The first portion of the track 32 generally forms an angle with the second portion 36 of the track. In particular, although the first 32 and/or second 36 portions may be somewhat curved, the portions of the first 32 and second 36 track portions located adjacent to the first intermediate location 34 can be visualized or averaged as straight lines. Alternately, tangents of the first 32 and second 36 track portions at the first intermediate location 34 can be drawn, and the straight lines/tangents form an angle therebetween.

The second track portion 36 extends from the first intermediate location 34 to the second rest location 38 which is located generally below the first intermediate location 34. The track 28 includes a third portion 40 which extends from the second rest location 38 to a second intermediate location 42. The third track portion 40 generally forms an angle with the second track portion 36 at the second rest location 38.

The second intermediate location 42 may be located above the second rest location 38. In the illustrated embodiment, the second intermediate location 42 is also located above the first intermediate location 34, although the second intermediate location 42 may also be located at the same height as or below the first intermediate location 34 if so desired.

The track 28 includes a fourth portion 44 which extends from the second intermediate location 42 to an intersection location 46 wherein the fourth portion 44 intersects the first portion 32. The fourth track portion 44 generally forms an angle with the third track portion 40 at the second intermediate location 42. Furthermore, the fourth track portion 44 generally forms an angle with the first track portion 32 at the intersection location 46. The intersection location 46 may be located generally above the first rest location 30. However, if desired, the intersection location 46 may be located at a lower position such that the first rest location 30 and the intersection location 46 generally coincide.

Thus, the track 28 forms a generally closed loop shape. Of course, by a "closed loop" it is not meant to imply that the "loop" is limited to any specific shape, such as an oval and the like. Instead, nearly any shape which forms a generally closed shape may be included. As will be seen below, the closed loop shape enables the protrusion 24 to easily and repeatedly return to its starting point for easy opening and closing of the cover 14. Furthermore, movement of the cover 14 between its open and closed positions causes the protrusion 24 to move in a generally closed loop path.

Figure 6:
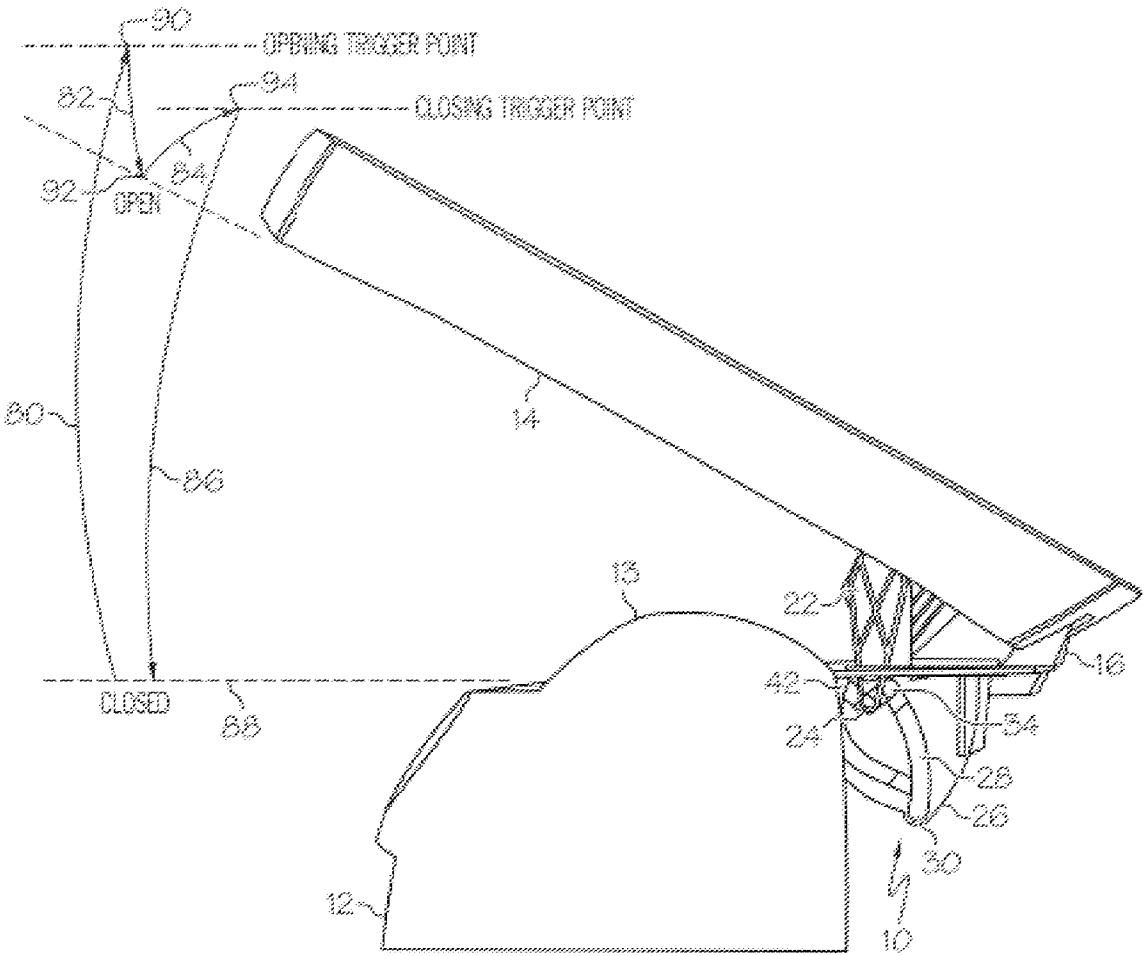
FIG. 6 is a side view of the multifunction machine of FIG. 1 illustrating operations required to open and/or close the lid.

As shown in FIGS. 2, 3 and 6, the protrusion 24 may be slidably received in the track 28 such that movement of the cover 14 between its open and closed positions causes the protrusion 24 to slide within or along the track 28. When the cover 14 is in its closed position, the protrusion 24 may be located in the first rest location 30 such that the bottom edge 50 of the first rest location 30 may support the protrusion 24 and stably support the cover 14 in its closed position. Alternately, the cover 14 may be supported by the frame of the printer such that the protrusion 24 is spaced slightly upwardly from the bottom edge 50 of the first location 30 when the cover 14 is in its closed position.

In order to move the cover 14 to its open position, the cover 14 is raised or pivoted about the hinge 16, which causes the protrusion 24 to slide along the first track portion 32 to the first intermediate location 34. The cover 14 may then be slightly lowered, thereby causing the protrusion 24 to slide in the second track portion 36 until the protrusion 24 arrives at the second rest location 38. The protrusion 24 may be smoothly guided from the first track portion 32 to the second track portion 36 and then into the second rest location 38 by the shape of the first 32 and second 36 track portions and by the spring bias nature of the arm 22.

Alternately, instead of utilizing a spring or a spring biased arm 22, the track 28 may include a plurality of ramp portions to guide the protrusion 24 and ensure that the protrusion 24 moves in the desired direction (i.e., in the illustrated embodiment generally counter-clockwise) about the track 28. For example, the first track portion 32 may include a first ramp 60 defining a lip 62 located adjacent to the first intermediate location 34 (see FIG. 3). Thus, any attempted movement of the protrusion 24 in the downward direction from the first intermediate location 34 will cause the protrusion 24 to abut against the lip 62, which will thereby block the attempted downward movement. Similarly, the second track portion 36 may similarly include a second ramp 64 defining a lip 66 which blocks attempted upward movement of the protrusion 24 from the second rest location 38. Furthermore, the protrusion 24 may make a clicking sound or feel when the protrusion rides over the lips 62, 66, Thus the ramps 60, 64 also provide sound and/or tactile feedback so that the user knows that the cover 14 can be lowered or released. Once the protrusion 24 is received in the second rest location 38, the cover 14 is stably supported in its open position and the cover 14 can be released by the user. For example, the protrusion 24 may rest upon the bottom edge 51 of the second rest location 38.

As shown in FIG. 5, the housing assembly 10 may include a supplemental arm 60 which is fixedly or pivotally coupled to the cover 14. The supplemental arm 60 may be located on an opposite side of the track body 26 relative to the arm 22 and track 28. The track body 26 may include a support tab 61 that protrudes generally outwardly from the face of the track body 26. The support tab 61 may be configured such that when the cover 14 is in its open position and the protrusion 24 is received in the second rest location 38, the supplemental arm 60 rests on and is supported by the support tab 61. In this manner, the support tab 61 and supplemental arm 60 cooperate to provide additional support to the cover 14 when the cover 14 is in its open position.

In order to return the cover 14 to its closed position, the cover 14 is lifted slightly, thereby pulling the protrusion 24 from the second rest location 38 to the second intermediate location 42 via the third track portion 40. Once the protrusion 24 is received in the second intermediate location 42, the cover 14 may be lowered, thereby causing the protrusion 24 to slide along the fourth track portion 44. Once the protrusion 24 passes through the intersection location 46, further lowering of the cover 14 urges the protrusion 24 into the first rest location 30, and the cover 14 is then returned to its closed position.

Because the first 30 and second 38 rest locations are relatively low locations relative to adjacent portions of the track 28, the cover 14 can thereby be stably retained in the open and closed positions. Further, because the intersection location 46 is located above the first rest location 30, the raised positioning of the intersection location 46 allows the cover 14 to be moved to the open position without first having to lower the cover 14 entirely into the closed position.

The third track portion 40 includes a third ramp 68 defining a lip 70 and the fourth track portion 44 includes a fourth ramp 72 defining a lip 74. The ramps 68, 72 and lips 70, 74 help to ensure that the protrusion 24 moves in the desired direction or path (e.g., in the counter-clockwise direction). The ramps 68, 72 also provide sound and/or tactile user feedback so that the user knows that the cover 14 can be lowered or released and is traveling in the proper manner. A portion of the surfaces of the ramps may be provided with ribbing or ridges to enhance user feedback. Of course, as outlined above, the track 28 may be shaped to ensure movement of the protrusion in the desired manner, and/or the arm 22 may be spring biased.

As shown in FIG. 6, movement of the cover 14 from its closed position to its open position and back to its closed position is diagramed by the four arrows 80, 82, 84, and 86. Movement of the cover 14 from the closed position 88 can be actuated by lifting (arrow 80) the cover 14 to an opening trigger point 90 (i.e., wherein the protrusion 24 is at the first intermediate location 34) and then lowering (arrow 82) the cover 14 to its stable propped-open position 92 (wherein the protrusion 24 is at the second rest location 38). The cover 14 can then be returned to its closed position by raising (arrow 84) the cover 14 to its closing trigger point 94 (i.e., wherein the protrusion is at the second intermediate location 42) and then lowering (arrow 86) the cover 14 to its closed position 88 such that the protrusion 24 is received in the first rest location 30. Thus, the cover 14 can be smoothly and easily moved from the open position 92 to the closed position 88 with a single hand operation. Further, the cover 14 can be smoothly and easily moved from the closed position 88 to the open position 92 with a single hand operation.

The position of the track 28 and the arm 22/protrusion 24 may be reversed such that the track 28 is located on the cover 14 and the arm 22/protrusion 24 is located on the base or body of the housing 12. In this case, the track 28 may be generally inverted from its position shown in the attached figures. Further in either configuration the track 28 and its various track portions 32, 36, 40, 44 and track locations 30, 34, 38, 42, 46 may all be modified as desired to ensure smooth sliding of the protrusion 24 and opening/closing of the cover 14. For example the angles formed by the various track portions 32, 36, 40, 44, the curvature of the track portions 32, 36, 40, 44, the locations and relative heights of the locations 30, 34, 38, 42, 46 etc. may all be modified as desired to provide the desired characteristics to the housing assembly 10.

Having described the invention in detail and by reference to the preferred embodiments, it will be apparent that modifications and variations thereof are possible without departing from the scope of the invention.

What is claimed is:

1. A housing assembly comprising:

a housing having an access opening wherein said housing is a housing of at least one of a printer, copier, facsimile machine or scanner;

a cover movable between a closed position wherein said cover generally covers said access opening and an open position wherein said cover generally does not cover said access opening;

a protrusion located on one of said housing or said cover; and a track located on the other one of said housing or said cover, said protrusion being slidably received in said track, and wherein said track forms a generally closed loop shape such that said protrusion slides in said track when said cover is moved between said open and said closed positions.

2. The assembly of claim 1 wherein movement of said cover from said closed position to said open position, and returning said cover to said closed position, causes said protrusion to slide in said track in a generally closed loop path.

3. The assembly of claim 1 further including an arm pivotally mounted to said one of said cover or said housing, and wherein said protrusion is located on said arm.

4. The assembly of claim 1 wherein said assembly further comprises:

a support tab located adjacent to said track;

an arm pivotally mounted to said one of said cover or said housing wherein said protrusion is located on said arm; and a supplemental arm that coupled to one of said cover or said housing, said supplemental arm being supported by said support tab when said cover is in said open position to thereby support said cover when said cover is in said open position.

5. A housing assembly comprising:

a housing having an access opening;

a cover movable between a closed position wherein said cover generally covers said access opening and an open position wherein said cover generally does not cover said access opening;

a protrusion located on one of said housing or said cover; and a track located on the other one of said housing or said cover, said protrusion being slidably received in said track, and wherein said track forms a generally closed loop shape such that said protrusion slides in said track when said cover is moved between said open and said closed positions wherein said track includes a first rest location and a second rest location, each rest location being a relatively low or a relatively high location such that any immediately adjacent portions of said track extend generally upwardly or generally downwardly away from the associated rest location, and wherein said protrusion is located in said first rest location when said cover is in said closed position and wherein said protrusion is located in said second rest location when said cover is in said open position.

6. The assembly of claim 5 wherein said second rest location is located above said first rest location.

7. The assembly of claim 5 wherein said track further comprises a portion of said track extending from said second rest location to said first rest location having a first ramp having a first defining lip with said first defining lip being adjacent to said first rest location and a portion of said track extending from said first rest location to said second rest location having a second ramp having a second defining lip with said second defining lip being adjacent said second rest location wherein said first and second ramps provide user feedback as said protrusion traverses said first and second ramps when closing and opening said cover and said first and second defining lips inhibit reverse motion of said protrusion in said track.

8. The assembly of claim 7 wherein at least one of said first and second ramps has a ribbed surface to provide user feedback.

9. The assembly of claim 6 wherein said track includes a first portion extending from said first rest location to a first intermediate location and a second portion extending from said first intermediate location to said second rest location, and wherein said first portion generally forms an angle with said second portion at said first intermediate location.

10. The assembly of claim 9 wherein said first intermediate location is located generally above said first rest location.

11. The assembly of claim 9 wherein said track further includes a third portion extending from said second rest location to a second intermediate location and wherein said third portion generally forms an angle with said second portion at said second rest location.

12. The assembly of claim 11 wherein at least one of said first portion and said third portion further comprises a ramp having a defining lip wherein said ramp provides user feedback as said protrusion traverses said ramp when closing and opening said cover and said defining lip inhibits reverse motion of said protrusion in said track.

13. The assembly of claim 12 wherein said ramp has a ribbed surface to provide user feedback.

14. The assembly of claim 11 wherein said track further includes a fourth portion extending from second intermediate location to an intersection location wherein said fourth portion intersects said first portion, and wherein said fourth portion generally forms an angle with said third portion at said second intermediate location.

15. The assembly of claim 14 wherein said second intermediate location is located generally above said second rest location.

16. The assembly of claim 14 wherein said intersection location is located generally at or adjacent to said first rest portion.

17. The assembly of claim 14 wherein said intersection location is located generally above said first rest location.

18. A housing assembly comprising:

a housing having an access opening;

a cover movable between a closed position wherein said cover generally covers said access opening and an open position wherein said cover generally does not cover said access opening;

a protrusion located on one of said housing or said cover; and a track located on the other one of said housing or said cover, said protrusion being slidably received in said track, and wherein said track forms a generally closed loop shape such that said protrusion slides in said track when said cover is moved between said open and said closed positions wherein said cover is movably coupled to said housing such that said cover is movable relative to said housing only in a pivotable movement about a single fixed axis.

19. A housing assembly comprising:

a housing having an access opening:

a cover movable between a closed position wherein said cover generally covers said access opening and an open position wherein said cover generally does not cover said access opening;

a protrusion located on one of said housing or said cover; and a track located on the other one of said housing or said cover, said protrusion being slidably received in said track, and wherein said track forms a generally closed loop shape such that said protrusion slides in said track when said cover is moved between said open and said closed positions, and wherein said track includes means to allow movement of said protrusion in a first direction and to generally block movement of said protrusion in a second direction.

20. A housing assembly comprising:

a housing having an access opening;

a cover pivotably coupled to said housing and movable between a closed position wherein said cover generally covers said access opening and an open position wherein said cover generally does not cover said access opening;

a protrusion located on one of said housing or said cover; and a track located on the other one of said housing or said cover, said protrusion being slidably received in said track, and wherein said track forms a generally closed loop shape such that said protrusion slides in said track when said cover is moved between said open and said closed positions, said track comprising:

a first rest location and a second rest location with said second rest location being generally above said first rest location, each rest location being a relatively low or a relatively high location such that any immediately adjacent portions of said track extend generally upwardly or generally downwardly away from the associated rest location, and wherein said protrusion is located in said first rest location when said cover is in said closed position and wherein said protrusion is located in said second rest location when said cover is in said open position; and a first, second, third and fourth portions, said first portion extending from said first rest location to a first intermediate location generally above said first rest location, said second portion extending from said first intermediate location to said second rest location generally below said first intermediate location wherein said first portion generally forms an angle with said second portion at said first intermediate location, said third portion extending from said second rest location to a second intermediate location generally above said second rest location wherein said third portion generally forms an angle with said second portion at said second rest location, and said fourth portion extending from second intermediate location to an intersection location with said first portion wherein said fourth portion generally forms an angle with said third portion at said second intermediate location, said fourth portion generally forms an angle with said first portion at said intersection location and said intersection location is generally above said first rest location.

21. The assembly of claim 20 wherein said track further comprises said first portion having a first ramp having a first defining lip adjacent to said first intermediate location, said second portion having a second ramp having a second defining lip adjacent said second rest location, said third portion having a third ramp having a third defining lip adjacent said second intermediate location, said fourth portion having a fourth ramp having a fourth defining lip adjacent said intersection location wherein said first, second, third and fourth ramps provide user feedback as said protrusion traverses said ramps when closing and opening said cover and said first, second, third and fourth defining lips inhibit reverse motion of said protrusion in said track.

22. The assembly of claim 21 wherein at least of said ramps has a ridged surface to provide user feedback.

23. The assembly of claim 20 wherein at least one of said first, second, third and fourth portions further comprises having a ramp having a defining lip wherein said ramp provides user feedback as said protrusion traverses said ramp when closing and opening said cover and said defining lip inhibits reverse motion of said protrusion in said track.

24. The assembly of claim 23 wherein said ramp has a ribbed surface to provide user feedback.

25. The assembly of claim 20 wherein movement of said cover from said closed position to said open position, and returning said cover to said closed position, causes said protrusion to slide in said track in one direction in a generally closed loop path.

26. The assembly of claim 20 wherein said assembly further comprises:

a support tab located adjacent to said track when said cover is in said open position;

an arm pivotally mounted to said one of said cover or said housing wherein said protrusion is located on said arm; and a supplemental arm that coupled to one of said cover or said housing, said supplemental arm being supported by said support tab when said cover is in said open position to thereby support said cover when said cover is in said open position.

* * * * *